US005593276A

United States Patent [19]

Proctor et al.

[11] Patent Number: 5,593,276

[45] Date of Patent: Jan. 14, 1997

[54] TURBINE SHROUD HANGER

[75] Inventors: Robert Proctor, West Chester; David R. Linger, Cincinnati; David A. Di Salle, West Chester; Steven R. Brassfield, Cincinnati; Larry W. Plemmons, Fairfield, all of Ohio

[73] Assignee: General Electric Company, Cincinnati, Ohio

[21] Appl. No.: 467,436

[22] Filed: Jun. 6, 1995

[51] Int. Cl.[6] ..... F01D 11/18

[52] U.S. Cl. ..... 415/173.1; 415/138

[58] Field of Search ..... 415/173.1, 173.3, 415/134, 138

[56] References Cited

U.S. PATENT DOCUMENTS

| | | | |
|---|---|---|---|
| 4,101,242 | 7/1978 | Coplin et al. . | |
| 4,303,371 | 12/1981 | Eckert . | |
| 4,573,866 | 3/1986 | Sandy, Jr. et al. . | |
| 4,627,233 | 12/1986 | Baran, Jr. | 415/115 X |
| 4,756,153 | 7/1988 | Roberts et al. | 415/139 |
| 4,897,021 | 1/1990 | Chaplin et al. | 415/139 |
| 5,071,313 | 12/1991 | Nichols | 415/134 |
| 5,169,287 | 12/1992 | Proctor et al. . | |
| 5,174,714 | 12/1992 | Plemmons et al. . | |
| 5,181,826 | 1/1993 | Rock | 415/173.1 |

OTHER PUBLICATIONS

General Electric Company, CF34–3A1 gas turbine engine in production more than 1 year; 3 figures showing high pressure turbine shrouds and unpublished proposed temporary fix.

*Primary Examiner*—Edward K. Look
*Assistant Examiner*—Michael S. Lee
*Attorney, Agent, or Firm*—Andrew C. Hess; Wayne O. Traynham

[57] ABSTRACT

A turbine shroud hanger is supported from an annular outer casing and includes an annular radial flange and integral forward and aft legs at a radially inner end thereof. The legs extend axially oppositely to each other and include respective distal ends configured for supporting a plurality of arcuate shroud panels radially above a plurality of turbine rotor blades to define a tip clearance therebetween. The legs include circumferentially spaced apart forward and aft slots extending axially from the distal ends thereof toward the radial flange, and completely radially therethrough to bifurcate the legs into circumferential segments for reducing transient thermal expansion of the hanger to reduce in turn expansion of the tip clearance.

11 Claims, 3 Drawing Sheets

TURBINE SHROUD HANGER

CROSS REFERENCE TO RELATED APPLICATION

The present invention is related to concurrently filed application Ser. No. 08/467,418, filed Jun. 6, 1995, entitled "SMART TURBINE SHROUD".

BACKGROUND OF THE INVENTION

The present invention relates generally to gas turbine engines, and, more specifically, to turbine shrouds therein.

A gas turbine engine includes in serial flow communication one or more compressors followed in turn by a combustor and high and low pressure turbines disposed axisymmetrically about a longitudinal axial centerline within an annular outer casing. During operation, the compressors are driven by the turbine and compress air which is mixed with fuel and ignited in the combustor for generating hot combustion gases. The combustion gases flow downstream through the high and low pressure turbines which extract energy therefrom for driving the compressors and producing output power either as shaft power or thrust for powering an aircraft in flight, for example.

Each of the turbines includes one or more stages of rotor blades extending radially outwardly from respective rotor disks, with the blade tips being disposed closely adjacent to a turbine shroud supported from the casing. The tip clearance defined between the shroud and blade tips should be made as small as possible since the combustion gases flowing therethrough bypass the turbine blades and therefore provide no useful work. In practice, however, the tip clearance is typically sized larger than desirable since the rotor blades and turbine shroud expand and contract at different rates during the various operating modes of the engine.

The turbine shroud has substantially less mass than that of the rotor blades and disk and therefore responds at a greater rate of expansion and contraction due to temperature differences experienced during operation. Since the turbines are bathed in hot combustion gases during operation, they are typically cooled using compressor bleed air suitably channeled thereto. In an aircraft gas turbine engine for example, acceleration burst of the engine during takeoff provides compressor bleed air which is actually hotter than the metal temperature of the turbine shroud. Accordingly, the turbine shroud grows radially outwardly at a faster rate than that of the turbine blades which increases the tip clearance and in turn decreases engine efficiency. During a deceleration chop of the engine, the opposite occurs with the turbine shroud receiving compressor bleed air which is cooler than its metal temperature causing the turbine shroud to contract relatively quickly as compared to the turbine blades, which reduces the tip clearance.

Accordingly, the tip clearance is typically sized to ensure a minimum tip clearance during deceleration, for example, for preventing or reducing the likelihood of undesirable rubbing of the blade tips against the turbine shrouds.

The turbine shroud therefore directly affects overall efficiency or performance of the gas turbine engine due to the size of the tip clearance. The turbine shroud additionally affects performance of the engine since any compressor bleed air used for cooling the turbine shroud is therefore not used during the combustion process or the work expansion process by the turbine blades and is unavailable for producing useful work. Accordingly, it is desirable to reduce the amount of bleed air used in cooling the turbine shroud for maximizing the overall efficiency of the engine.

In order to better control turbine blade tip clearances, active clearance control systems are known in the art and are relatively complex for varying during operation the amount of compressor bleed air channeled to the turbine shroud. In this way the bleed air may be provided as required for minimizing the tip clearances, and the amount of bleed air may therefore be reduced. However, in order to minimize the complexity and cost of providing clearance control, typical turbine shrouds are unregulated in cooling the various components thereof.

SUMMARY OF THE INVENTION

A turbine shroud hanger is supported from an annular outer casing and includes an annular radial flange and integral forward and aft legs at a radially inner end thereof. The legs extend axially oppositely to each other and include respective distal ends configured for supporting a plurality of arcuate shroud panels radially above a plurality of turbine rotor blades to define a tip clearance therebetween. The legs include circumferentially spaced apart forward and aft slots extending axially from the distal ends thereof toward the radial flange, and completely radially therethrough to bifurcate the legs into circumferential segments for reducing transient thermal expansion of the hanger to reduce in turn expansion of the tip clearance.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
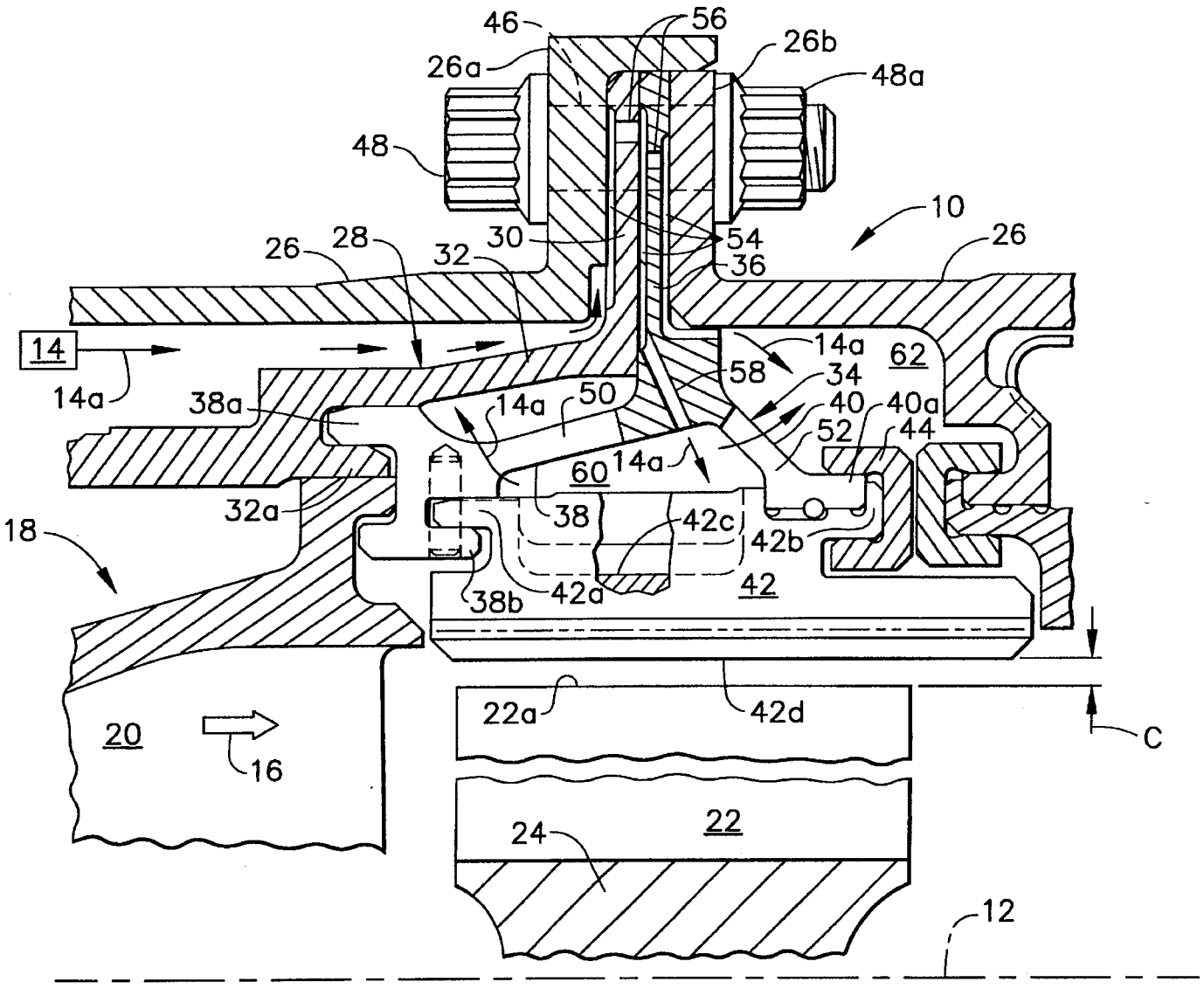
FIG. 1 is a partly sectional axial view through a portion of an axisymmetrical turbine shroud including a hanger in accordance with one embodiment of the present invention which supports shroud panels radially above a row of turbine rotor blades extending outwardly from a rotor disk.

Illustrated in FIG. 1 is an exemplary embodiment of a turbine shroud 10 which is axisymmetrical about an axial centerline axis 12 in an aircraft gas turbine engine. The aircraft engine also includes one or more conventional compressors one of which is represented schematically by the box 14, with compressed air being channeled to a conventional combustor (not shown) in which the air is mixed with fuel and ignited for generating hot combustion gases 16 which are discharged axially therefrom.

Disposed downstream from the combustor is a conventional high pressure turbine (HPT) 18 which receives the combustion gases 16 for extracting energy therefrom. In this exemplary embodiment, the HPT 18 includes at least two stages, with the first stage not being illustrated, and portions of the second stage being illustrated in FIG. 1. The second stage includes a conventional second stage stationary turbine nozzle 20 having a plurality of circumferentially spaced apart stator vanes extending radially between outer and inner annular bands. Disposed downstream from the nozzle 20 are a plurality of circumferentially spaced apart second stage turbine rotor blades 22 extending radially outwardly from a second stage rotor disk 24 axisymmetrically around the centerline axis 12.

The turbine shroud 10 illustrated in FIG. 1 is an assembly including a corresponding portion of an annular outer stator casing 26 which provides a stationary support for the several components thereof. The outer casing 26 is axially split at a pair of adjacent first and second radial flanges 26*a* and 26*b* which complement each other and are formed as respective integral ends of the casing 26 at the splitline. An annular, one-piece shroud ring or support 28 is suspended from the casing first and second flanges 26*a,b*. The shroud support 28 is generally L-shaped in transverse section and has an annular radial support flange 30 and an integral annular forward support leg 32 which extends axially forwardly from a radially inner end of the support flange 30. The forward support leg 32 extends further axially forwardly for additionally supporting the first stage turbine shroud (not shown) which is not the subject of the present invention.

An annular, one-piece shroud ring or hanger 34 is also suspended from the casing first and second flanges 26*a,b* and is disposed with the shroud support 28 coaxially about the centerline axis 12. The shroud hanger 34 is generally Y-shaped in transverse section and has an annular radial hanger flange 36, and integral annular forward and aft hanger legs 38, 40 at a radially inner end thereof. The forward and aft legs 38, 40 extend axially oppositely to each other, with the forward leg 38 having a forward distal end 38a in the form of a first hook which is conventionally supported on a corresponding first hook 32*a* of the forward support leg 32.

A plurality of arcuate shroud panels 42 are conventionally removably fixedly joined to the hanger legs 38, 40 by corresponding forward and aft hooks 42*a* and 42*b*. The panel forward hook 42*a* is simply disposed on a corresponding second hook 38*b* of the forward leg 38, with the panel aft hook 42*b* being joined to an aft distal end 40*a* of the aft leg 40 by a conventional C-clip 44.

Each of the shroud panels 42 has an outer surface 42*c* which faces radially outwardly towards the bottom surface of the shroud hanger 34. Each panel 42 also includes a radially inner surface 42*d* which is positionable radially above tips 22*a* of the rotor blades 22 to define a tip clearance C therebetween.

The support flange 30 and the hanger flange 36 are axially positioned or sandwiched between the first and second casing flanges 26*a,b* in abutting or sealing contact with each other, with all four flanges 26*a*, 30, 36, and 26*b* having a plurality of circumferentially spaced apart, axially extending common or aligned bolt holes 46 (shown in dashed line in FIG. 1). The bolt holes 46 are arranged on a common radius, i.e. circumferentially extending bolt line, with each bolt hole 46 receiving a respective bolt 48 (and complementary nut 48*a*) for axially clamping together the four flanges to support the shroud panels 42 from the casing 26.

In accordance with the present invention, the hanger forward and aft legs 38, 40 include respective pluralities of circumferentially spaced apart forward and aft sawcuts or slots 50, 52 extending partly axially from the forward and aft distal ends 38*a*, 40*a*, respectively, toward the base of the radial flange 36. The forward and aft slots 50, 52 also extend completely radially through the legs 38, 40 to bifurcate the legs 38, 40 into circumferential segments 38*s*, 40*s* as illustrated more particularly in FIGS. 2 and 3 for reducing transient thermal expansion of the hanger 34 to reduce in turn expansion of the tip clearance C as the shroud panels 42 travel with the hanger forward and aft legs 38, 40.

More specifically, FIG. 1 illustrates an exemplary flowpath of compressor bleed air 14*a* which flows from the compressor 14 axially aft over the shroud support forward leg 32 and then radially upwardly into the supporting joint defined by the casing first flange 26*a*, the shroud support flange 30, the hanger radial flange 36, and the casing second flange 26*b*. Suitable recesses 54 are at the interfaces of the four flanges, and metering holes 56 extend axially through the support flange 30 and the radial flange 36. The recesses 54 and metering holes 56 allow the bleed air 14*a* to flow radially outwardly between the casing first flange 26*a* and the support flange 30, and then flow axially through the metering holes 56 in the support flange 30. The bleed air 14*a* then flows radially downwardly through the recess 54 between the support flange 30 and the radial flange 36, with a portion of the bleed air 14*a* flowing axially through the metering holes 56 in the radial flange 36 to provide flow communication into the last recess 54 between the radial flange 36 and the casing second flange 26*b*.

Disposed at the base of the radial flange 36 in flow communication with the recess 54 thereof, are a plurality of circumferentially spaced apart impingement holes 58 which discharge the bleed air 14*a* in impingement against the outer surface 42*c* of the shroud panels 42 for cooling thereof. As indicated above, the radial flange 36 and the forward and aft legs 38, 40 are configured generally in a Y-shape axial section to define a forward or shroud cavity 60 radially above the shroud panels 42. The hanger aft leg 40 and the inside of the casing 26 define an aft cavity 62. The bleed air 14*a* discharged from the aft-most recesses 54 is received in the aft cavity 62. The bleed air 14*a* discharged through the impingement holes 58 is received in the shroud cavity 60 between the forward and aft legs 38, 40 and collects therein after impinging against the panels 42. The forward and aft slots 50, 52 are preferably sized to maintain pressurization of the shroud cavity 60 to maintain backflow pressure margin therein notwithstanding leakage of the bleed air 14*a* radially outwardly through the forward and aft slots 50, 52.

Without the slots 50, 52, the shroud hanger 34 would be a complete 360° ring which would expand and contract radially with circumferential hoop stresses being generated therein. Since the hanger 34 is bathed in the bleed air 14*a*, and has relatively small mass compared to the mass of the rotor blades 22 and rotor disks 24, it has a relatively fast thermal response time which is significantly reduced by providing the bifurcating slots 50, 52. The slots 50, 52 eliminate the continuous ring configuration of both the forward and aft legs 38, 40, while the radial flange 36 retains its full 360° ring configuration. In this way, the forward and aft legs 38, 40 no longer respond as full rings which reduces the transient thermal expansion thereof. Instead, the forward and aft legs 38, 40 thermally respond as finite circumferential segments 38*s*, 40*s* to correspondingly modify the thermal response of the hanger 34 for improving clearance control at the panels 42. The slots 50, 52 have the added benefit of cutting the hoop stress which would otherwise occur in the legs 38, 40. The resulting leg segments 38*s*, 40*s* will enjoy reduced transient thermal radial expansion when heated by the bleed air 14*a* during an acceleration burst for example which in turn reduces the undesirable enlargement of the tip clearance C.

However, leakage of the bleed air 14*a* from the shroud cavity 60 necessarily results but may be suitably minimized by optimizing the dimensions of the slots 50, 52. However, the slots 50, 52 should be adequately sized in order to prevent closing of the slots 50, 52 during thermal response which would otherwise provide undesirable abutting contact between the adjacent leg segments 38*s* and 40*s*.

Figure 2:
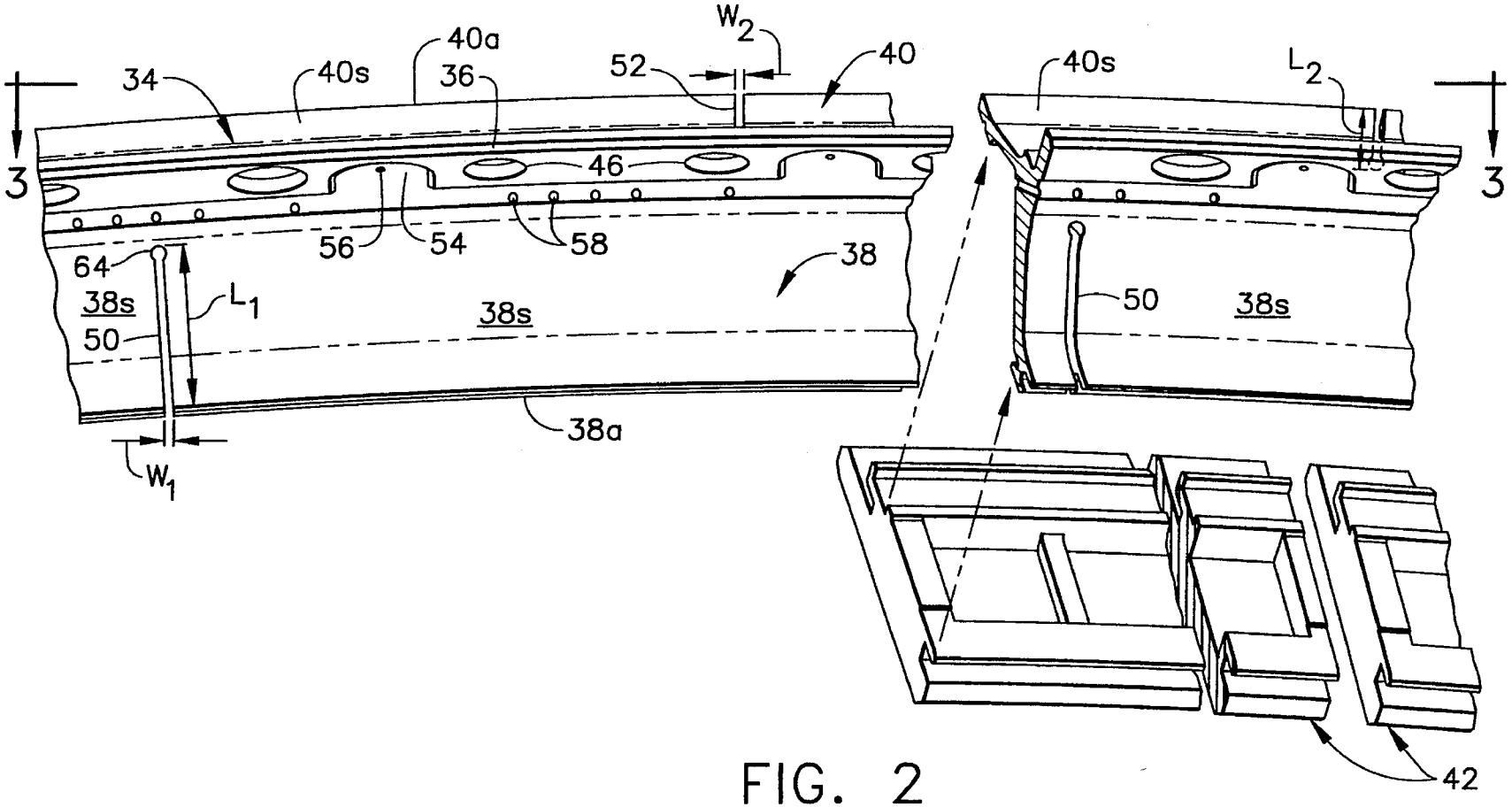
FIG. 2 is an exploded, forward facing aft perspective view of a portion of the shroud hanger illustrated in FIG. 1 which supports the shroud panels.
Figure 3:
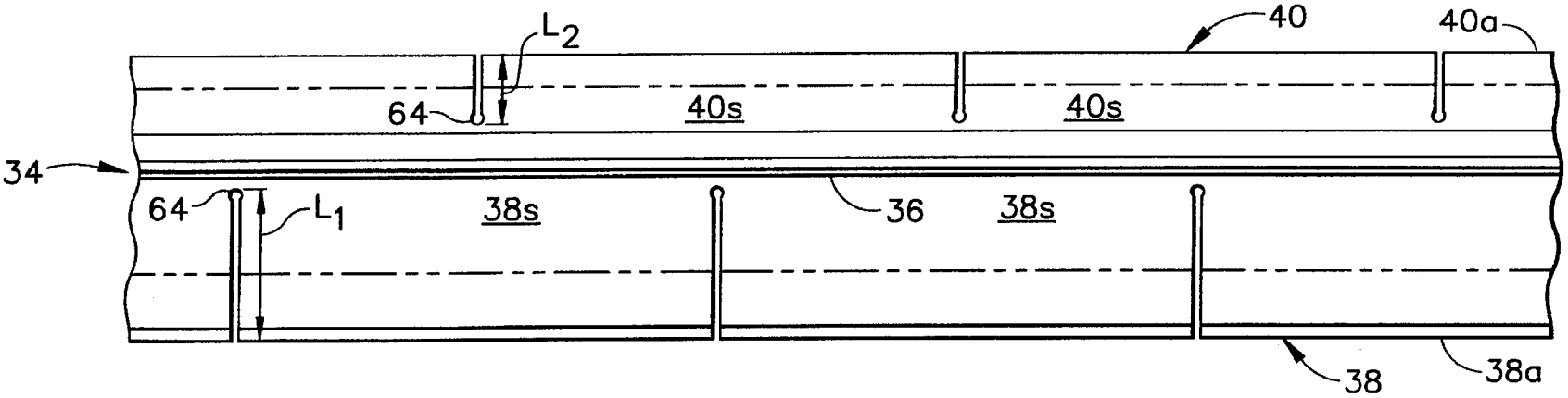
FIG. 3 is a top view of the shroud hanger illustrated in FIG. 2 and taken along line 3—3.

As illustrated in FIGS. 2 and 3, the forward and aft slots 50, 52 have respective axial lengths $L_1$ and $L_2$ measured axially inwardly from the distal ends 38*a*, 40*a* thereof. The slots also have respective circumferential widths $W_1$ and $W_2$. The widths $W_1$, $W_2$, are predetermined or preselected in size for accommodating without closing of the slots 50, 52 or abutting contact of the respective segments 38*s*, 40*s* due to circumferential thermal expansion of the forward and aft leg segments 38*s*, 40*s* upon radial thermal expansion of the hanger 34. As the hanger 34 thermally expands, the individual leg segments 38*s*, 40*s* also expand in the circumferential direction tending to close the slots 50, 52. Accordingly, the widths $W_1$, $W_2$ are suitably sized to ensure that upon expansion of the hanger 34 the slots 50, 52 are not allowed to close during operation.

As shown in FIG. 2, each of the slots 50, 52 preferably includes a respective stress relieving aperture 64 at its junction with the radial flange 36. The apertures 64 are preferably circular for minimizing stress concentrations thereat.

Referring again to FIGS. 2 and 3, the axial lengths $L_1$ and $L_2$ of the forward and aft slots 50, 52 are also predetermined in size for reducing transient rocking of the forward and aft legs 38, 40 about the radial flange 36 to reduce in turn rocking of the shroud panels 42 themselves for maintaining the panels 42 substantially level or horizontal during operation to control variation of the tip clearance C. Since the shroud hanger 34 has a general Y-shape section, and is suspended by the radial flange 36 it is subject to rocking movement during thermal expansion and contraction. In the exemplary embodiment illustrated in FIG. 1, the forward and aft legs 38, 40 are different in size or axial length, as well as different in configuration, and therefore the forward and aft slots 50, 52 preferably have different lengths $L_1$, $L_2$, as shown in FIG. 3 so that rocking of the legs 38, 40 may be minimized during operation. Since the legs 38, 40 are not only different in configuration but also subject to differing thermal input thereto, the forward and aft slots 50, 52 provide a useful design factor which may be used to advantage for minimizing the undesirable thermal movement of the legs 38, 40 during operation. Both the lengths and the widths of the forward and aft slots 50, 52, as well as their number and relative position may be used to optimize transient thermal performance of the hanger 34 to reduce the variation in the tip clearance C, which in turn improves efficiency of the engine.

In the exemplary embodiment illustrated in FIGS. 2 and 3, the forward and aft slots 50, 52 are preferably disposed perpendicularly to the radial flange 36, i.e. parallel to the axial centerline axis 12 of FIG. 1, although they could be inclined in other embodiments if desirable. The forward and aft slots 50, 52 also extend in this exemplary embodiment substantially axially up to the radial flange 36 at both sides thereof for substantially the entire lengths of the legs 38, 40.

The forward and aft slots 50, 52 are also preferably indexed or clocked relative to each other at different circumferential positions. For example the forward slots 50 are circumferentially spaced equidistantly between respective ones of the aft slots 52 as shown more clearly in FIG. 3. In this way, loads and stresses between the legs 38, 40 and the radial flange 36 may be tailored for maximizing the useful structural life of the shroud hanger 34.

Although the shroud hanger 34 is disclosed in the Figures in a specific turbine shroud assembly 10, it may find utility in other arrangements wherein one or more axial legs are suspended from an annular radial flange. The slots are effective for bifurcating the leg into circumferential segments which reduces transient thermal expansion thereof while cutting hoop stress. Where oppositely extending legs are utilized, respective slots therein may be used for minimizing thermal rocking movement thereof for maintaining a predetermined orientation such as for keeping the shroud panels 42 level during operation.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A turbine shroud hanger being suspendable radially inwardly from a pair of adjacent radial flanges of an outer casing comprising:

a one-piece annular hanger radial flange and an integral hanger leg at a radially inner end thereof; said hanger leg including a plurality of circumferentially spaced apart slots extending axially therethrough to bifurcate said leg into circumferential segments for reducing transient thermal expansion of said hanger.

2. A hanger according to claim 1 further comprising:

integral forward and aft hanger legs at said radially inner end of said radial flange;

said forward and aft legs extending axially oppositely to each other and including respective distal ends configured for supporting a plurality of arcuate shroud panels therefrom positionable radially outwardly from a plurality of turbine rotor blades to define a tip clearance therebetween; and said forward and aft legs including respective pluralities of circumferentially spaced apart forward and aft slots extending axially from said forward and aft distal ends, respectively, toward said radial flange, and completely radially therethrough to bifurcate said forward and aft legs into circumferential segments for reducing transient thermal expansion of said hanger to reduce in turn expansion of said tip clearance as said shroud panels travel with said hanger forward and aft legs.

3. A hanger according to claim 2 wherein said forward and aft slots have respective axial lengths and circumferential widths, and said widths are predetermined in size for accommodating without closing said slots due to circumferential thermal expansion of said forward and aft leg segments upon radial thermal expansion of said hanger.

4. A hanger according to claim 3 wherein said axial lengths of said forward and aft slots are predetermined in size for reducing transient rocking of said forward and aft legs about said radial flange to reduce in turn rocking of said shroud panels for maintaining said shroud panels substantially level during operation to control said tip clearance.

5. A hanger according to claim 4 wherein said forward and aft slots are disposed perpendicular to said radial flange.

6. A hanger according to claim 4 wherein said forward and aft slots extend substantially axially up to said radial flange.

7. A hanger according to claim 4 wherein said forward and aft slots are circumferentially indexed relative to each other at different circumferential positions.

8. A hanger according to claim 7 wherein said forward slots are circumferentially spaced equidistantly between respective ones of said aft slots.

9. A hanger according to claim 4 wherein said forward and aft legs are different in size, and said forward and aft slots have different lengths.

10. A hanger according to claim 4 further including a respective stress relieving aperture at the junction of each of said forward and aft slots with said radial flange.

11. A hanger according to claim 4 wherein:

said radial flange and said forward and aft legs are configured generally in a Y-shape in section to define a shroud cavity radially above said shroud panels;

said radial flange includes a plurality of impingement holes extending therethrough into said shroud cavity between said forward and aft legs for impinging bleed air against said shroud panels and pressurizing said shroud cavity; and said forward and aft slots are sized to maintain backflow pressure margin in said shroud cavity notwithstanding leakage of said bleed air radially outwardly through said forward and aft slots.

* * * * *